US010924854B2

(12) United States Patent
Chen

(10) Patent No.: US 10,924,854 B2
(45) Date of Patent: Feb. 16, 2021

(54) THREE-PIECE EXTENSIBLE MOVABLE SOUNDBOX

(71) Applicant: ECHOWELL ELECTRONIC CO., LTD., New Taipei (TW)

(72) Inventor: Hsi-Hsien Chen, New Taipei (TW)

(73) Assignee: ECHOWELL ELECTRONIC CO., LTD., New Taipei (TW)

( * ) Notice: Subject to any disclaimer, the term of this patent is extended or adjusted under 35 U.S.C. 154(b) by 0 days.

(21) Appl. No.: 16/454,262

(22) Filed: Jun. 27, 2019

(65) Prior Publication Data

US 2020/0413193 A1 Dec. 31, 2020

(51) Int. Cl.

| | |
|---|---|
| ***H04R 5/02*** | (2006.01) |
| ***H04R 1/02*** | (2006.01) |
| ***H04R 1/40*** | (2006.01) |

(52) U.S. Cl.

CPC ..... *H04R 5/02* (2013.01); *H04R 1/02* (2013.01); *H04R 1/403* (2013.01); *H04R 2201/029* (2013.01); *H04R 2201/403* (2013.01)

(58) Field of Classification Search

CPC . H04R 5/02; H04R 1/02; H04R 1/403; H04R 2201/029; H04R 2201/403

USPC ..... 381/79, 87, 120, 301, 303, 333, 334

See application file for complete search history.

(56) References Cited

U.S. PATENT DOCUMENTS

2002/0176593 A1* 11/2002 Magnusson ..... H04R 5/023 381/301
2004/0264708 A1* 12/2004 Dupeire ..... H04R 5/04 381/79
2018/0176686 A1* 6/2018 Ang ..... H04R 5/04

FOREIGN PATENT DOCUMENTS

GB 2252197 A * 7/1992 ..... H01B 7/0807

* cited by examiner

*Primary Examiner* — Vivian C Chin
*Assistant Examiner* — Friedrich Fahnert
(74) *Attorney, Agent, or Firm* — Locke Lord LLP; Tim Tingkang Xia, Esq.

(57) ABSTRACT

A three-piece extensible movable soundbox includes: a host portion; a first soundbox portion, wherein the host portion is extensibly connected to the first soundbox portion by a first connection line device; and a second soundbox portion, wherein the host portion is extensibly connected to the second soundbox portion by a second connection line device.

8 Claims, 6 Drawing Sheets

THREE-PIECE EXTENSIBLE MOVABLE SOUNDBOX

BACKGROUND OF THE INVENTION

Field of the Invention

The present disclosure relates to three-piece extensible movable soundboxes and, more particularly, to a three-piece extensible movable soundbar.

Description of the Prior Art

Conventional soundbars are bar-shaped in order to be suitable for use with flat-screen television sets or television sets of home theater systems; the soundbar and the host are integrated with each other. Hence, every television set requires a soundbar of a matching size to the detriment of ease of use. In addition, an integrated soundbar (especially a vacuum-tube-based soundbar) is bulky and thus very inconvenient to produce and deliver. In view of this, it is important to provide a soundbox that is not only convenient to produce and deliver but also adjustable in terms of its position.

SUMMARY OF THE INVENTION

In view of the aforesaid drawbacks of the prior art, it is an objective of the present disclosure to provide a three-piece extensible movable soundbox that is not only convenient to produce and deliver but also adjustable in terms of its position.

In order to achieve the above and other objectives, the present disclosure provides a three-piece extensible movable soundbox, comprising: a host portion; a first soundbox portion, wherein the host portion is extensibly connected to the first soundbox portion by a first connection line device; and a second soundbox portion, wherein the host portion is extensibly connected to the second soundbox portion by a second connection line device.

In a preferred embodiment, the first connection line device comprises a first reeling device and a first connection line, the second connection line device comprises a second reeling device and a second connection line, the first reeling device extends or halts the first connection line, and the second reeling device extends or halts the second connection line.

In a preferred embodiment, the first reeling device and the second reeling device are disposed in the host portion.

In a preferred embodiment, the three-piece extensible movable soundbox further comprises a first subsidiary component and a second subsidiary component, the first subsidiary component is demountably connected between the host portion and the first soundbox portion and contains the first connection line therein, the second subsidiary component is demountably connected between the host portion and the second soundbox portion and contains the second connection line therein.

In a preferred embodiment, the first connection line is connected, in a pluggable and unpluggable manner, to the first soundbox portion, and the second connection line is connected, in a pluggable and unpluggable manner, to the second soundbox portion.

In a preferred embodiment, the first connection line device comprises a first flat connection line capable of extension and connection, the first flat connection line comprises four first electrical connection lines, the second connection line device comprises a second flat connection line capable of extension and connection, and the second flat connection line comprises four second electrical connection lines.

In a preferred embodiment, a first connecting portion of the first soundbox portion is connectable to a first host connecting portion of the host portion, and a second connecting portion of the second soundbox portion is connectable to a second host connecting portion of the host portion.

In a preferred embodiment, the first connecting portion has a first magnet, the second connecting portion has a second magnet, the host portion has a third magnet and a fourth magnet, the first connecting portion is connected to the first host connecting portion by the first magnet and the third magnet, and the second connecting portion is connected to the second host connecting portion by the second magnet and the fourth magnet.

In a preferred embodiment, the first magnet, the second magnet, the third magnet and the fourth magnet are neodymium-iron-boron magnets.

In a preferred embodiment, a rear end of the host portion has a stepped structure.

The aforesaid and other aspects of the present disclosure are rendered clear and comprehensible by non-restrictive, specific embodiments, accompanying drawings and detailed descriptions below.

DETAILED DESCRIPTION OF THE EMBODIMENTS

Figure 1:
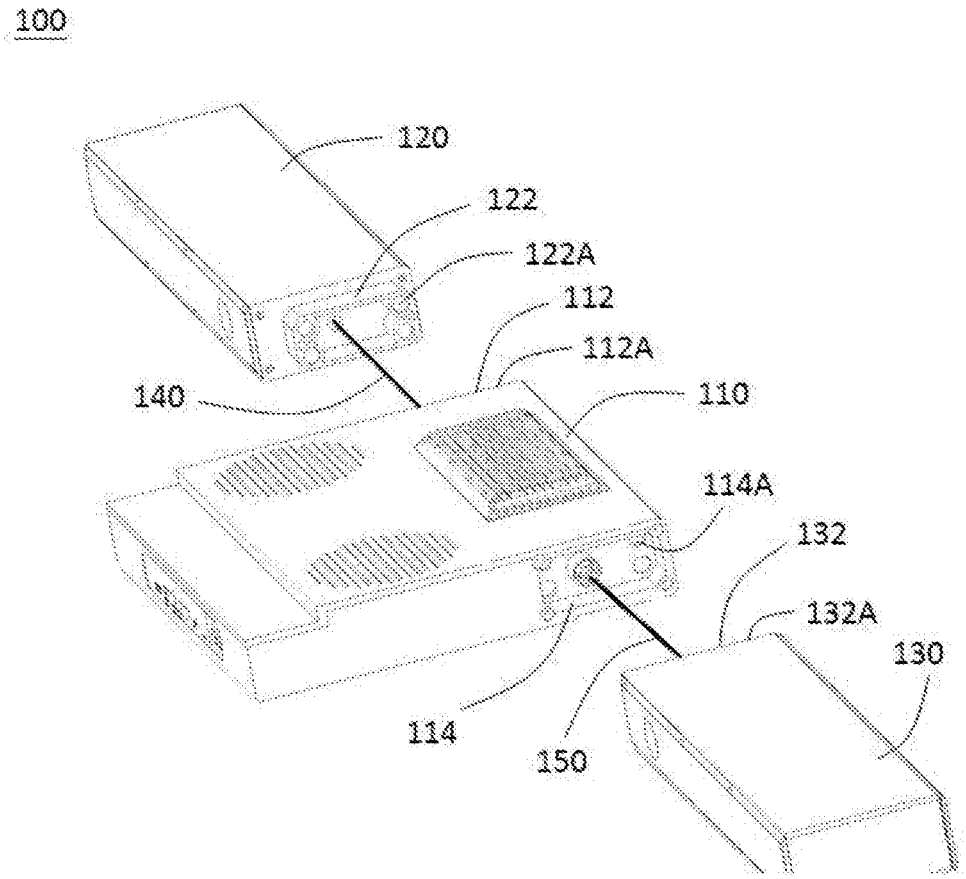
FIG. 1 is a schematic view of a three-piece extensible movable soundbox according to a specific embodiment of the present disclosure.

Referring to FIG. 1, there is shown a schematic view of a three-piece extensible movable soundbox according to a specific embodiment of the present disclosure. In the embodiment shown in FIG. 1, a three-piece extensible movable soundbox 100 is a soundbar. The three-piece extensible movable soundbox 100 comprises a host portion 110, a first soundbox portion 120 and a second soundbox portion 130. The host portion 110 is extensibly connected to the first soundbox portion 120 by a first connection line device 140. The host portion 110 is extensibly connected to the second soundbox portion 130 by a second connection line device 150.

In a specific embodiment, the host portion 110 has a first host connecting portion 112 and a second host connecting portion 114. The first host connecting portion 112 has a third magnet 112A. The second host connecting portion 114 has a fourth magnet 114A (Although the first host connecting portion 112 and the third magnet 112A are not shown in FIG. 1, their relative positions are similar to the relative positions of the second host connecting portion 114 and the fourth magnet 114A; hence, FIG. 1 is sufficient to illustrate the relative positions of the first host connecting portion 112 and the third magnet 112A.) In addition, the first soundbox portion 120 has a first connecting portion 122. The first connecting portion 122 has a first magnet 122A. The second soundbox portion 130 has a second connecting portion 132. The second connecting portion 132 has a second magnet 132A (Although the second connecting portion 132 and the second magnet 132A are not shown in FIG. 1, their relative positions are similar to the relative positions of the first connecting portion 122 and the first magnet 122A; hence, FIG. 1 is sufficient to illustrate the relative positions of the second connecting portion 132 and the second magnet 132A.) The first connecting portion 122 of the first soundbox portion 120 is connectable to the first host connecting portion 112 of the host portion 110, and the connection is firm because of the attraction between the first magnet 122A and the third magnet 112A. The second connecting portion 132 of the second soundbox portion 130 is connectable to the second host connecting portion 114 of the host portion 110, and the connection is firm because of the attraction between the second magnet 132A and the fourth magnet 114A.

In a specific embodiment, the first magnet 122A, second magnet 132A, third magnet 112A and fourth magnet 114A are neodymium-iron-boron magnets. In a specific embodiment, the first magnet 122A, second magnet 132A, third magnet 112A and fourth magnet 114A are diagonally located (for example, located at the upper right corner and the lower left corner) and disposed at the first connecting portion 122, second connecting portion 132, first host connecting portion 112 and second host connecting portion 114, respectively. In another embodiment, the magnets are disposed in another manner according to requirements; for instance, the magnets are disposed at all the four corners, or only one magnet is centrally located. However, the present disclosure is not limited thereto. In addition, in a variant specific embodiment, the first magnet 122A, second magnet 132A, third magnet 112A and fourth magnet 114A shown in FIG. 1 are either disposed in the first connecting portion 122, second connecting portion 132, first host connecting portion 112 and second host connecting portion 114, respectively, rather than exposed, or are exposed in part or in whole, as needed. For instance, the first magnet 122A, second magnet 132A, third magnet 112A and fourth magnet 114A are produced by embedded injection molding in a plastic molding process, and thus their finished products from their appearance do not reveal any magnet.

Figure 2:
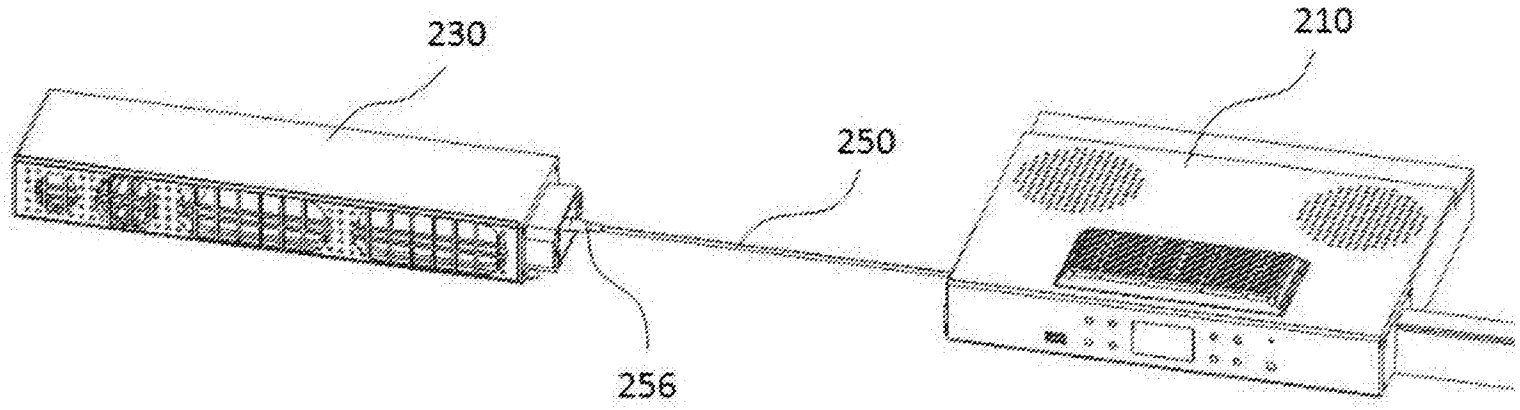
FIG. 2 is a schematic view of a connection line device connected, in a pluggable and unpluggable manner, to a soundbox portion according to a specific embodiment of the present disclosure.

In a specific embodiment, the three-piece extensible movable soundbox 100 is vacuum-tube-based. In a specific embodiment, a first connection line (see FIG. 3 for the first connection line) of the first connection line device 140 is connected, in a pluggable and unpluggable manner, to the first soundbox portion 120, whereas the second connection line (see FIG. 3 for the second connection line) of the second connection line device 150 is connected, in a pluggable and unpluggable manner, to the second soundbox portion 130. Referring to FIG. 2, there is shown a schematic view of the connection line of a connection line device connected, in a pluggable and unpluggable manner, to a soundbox portion according to a specific embodiment of the present disclosure. In the embodiment shown in FIG. 2, the front end of the connection line of a connection line device 250 has a connector 256. Therefore, a host portion 210 is connected, in a pluggable and unpluggable manner, to the soundbox portion 230 by the connector 256 of the connection line of the connection line device 250.

Figure 3:
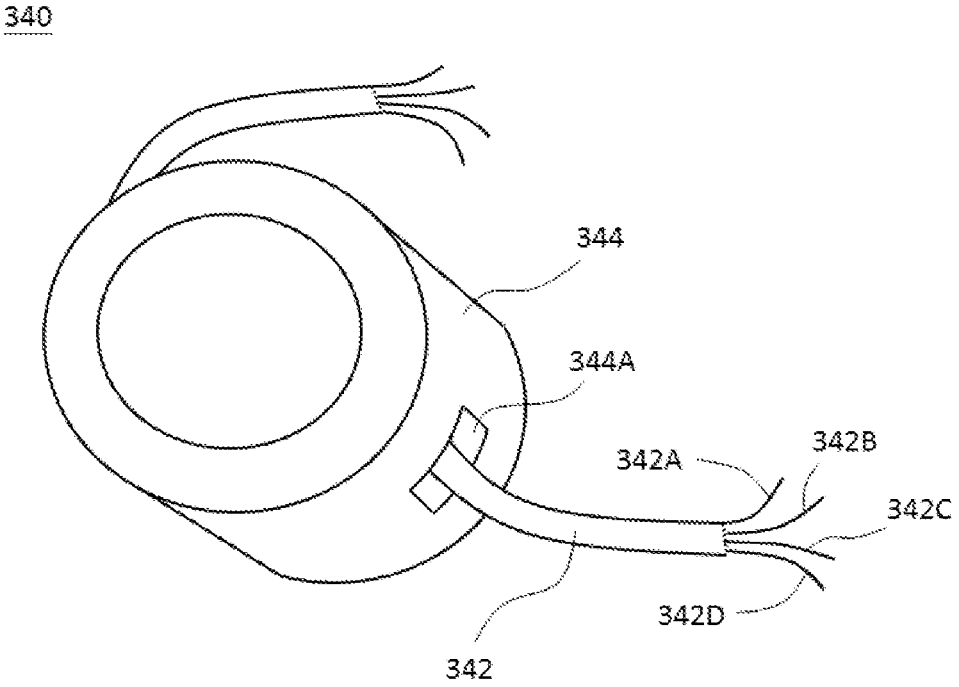
FIG. 3 is a schematic view of a connection line device according to a specific embodiment of the present disclosure.

Referring to FIG. 3, there is shown a schematic view of a connection line device according to a specific embodiment of the present disclosure. In the embodiment shown in FIG. 3, a connection line device 340 comprises a connection line 342 and a reeling device 344. The reeling device 344 can extend or halt the connection line 342. For instance, as soon as a user pulls the front end of the connection line 342, the connection line 342 kept in the reeling device 344 is let out from an inlet 344A continually. Afterward, if the user stops pulling the connection line 342, the reeling device 344 will halt the connection line 342 and thereby prevent the connection line 342 from being let out from the inlet 344A or retracted into the inlet 344A. When the reeling device 344 is in a halt state, the user can pull the connection line 342 again so as to start the reel-in mechanism of the reeling device 344, thereby causing the connection line 342 to retract into the inlet 344A. Understandably, the reel-in mechanism and the reel-out mechanism of the reeling device 344, as described herein, merely serve exemplary purposes, but the present disclosure is not limited thereto.

In addition, as shown in FIG. 3, the connection line 342 is a flat connection line comprising therein four electrical connection lines 342A, 342B, 342C, 342D. In a specific embodiment, the electrical connection lines 342A, 342B are for use in low-pitch output, whereas the electrical connection lines 342C, 342D are for use in high-pitch output. Understandably, FIG. 3 serves illustrative purposes, the electrical connection lines 342A, 342B, 342C, 342D in the connection line 342 are not located at the front end of the connection line 342, but the front end of the connection line 342 has a connector, so as to be conveniently connected to the soundbox portion.

The connection line device shown in FIG. 3 helps explain an embodiment of the second connection line device 150 and the first connection line device 140 shown in FIG. 1. In a specific embodiment, both the reeling device of the first connection line device and the reeling device of the second connection line device are disposed in the host portion. In another specific embodiment, the reeling device of the first connection line device and the reeling device of the second connection line device are disposed outside the host portion as needed or only partially exposed from the host portion as needed.

Figure 4:
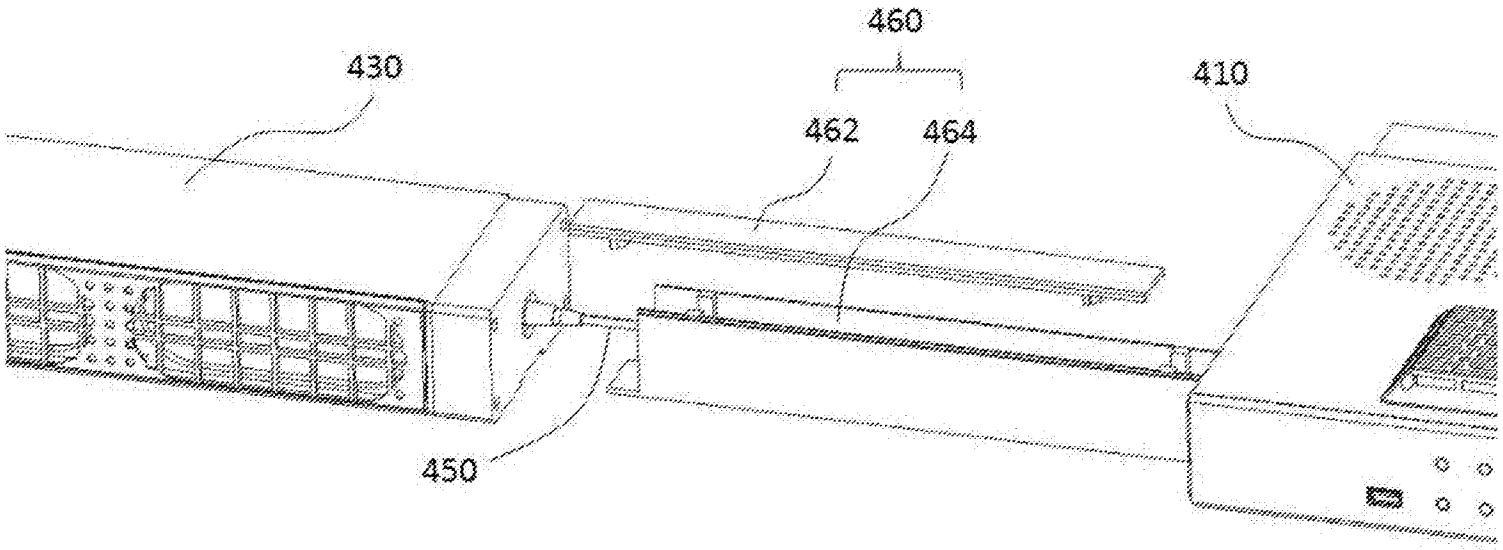
FIG. 4 is a schematic view of the three-piece extensible movable soundbox according to another specific embodiment of the present disclosure.

Referring to FIG. 4, there is shown a schematic view of the three-piece extensible movable soundbox according to another specific embodiment of the present disclosure. In the embodiment shown in FIG. 4, the three-piece extensible movable soundbox further comprises a subsidiary component 460. The subsidiary component 460 comprises a first subsidiary component portion 462 and a second subsidiary component portion 464. The subsidiary component 460 is demountably connected between the host portion 410 and the soundbox portion 430 and contains a connection line 450 therein. In a specific embodiment, the three-piece extensible movable soundbox comprises two subsidiary components, wherein the first subsidiary component is connected between the host portion and the first soundbox portion and contains the first connection line therein, whereas the second subsidiary component is connected between the host portion and the second soundbox portion and contains the second connection line therein.

Figure 5:
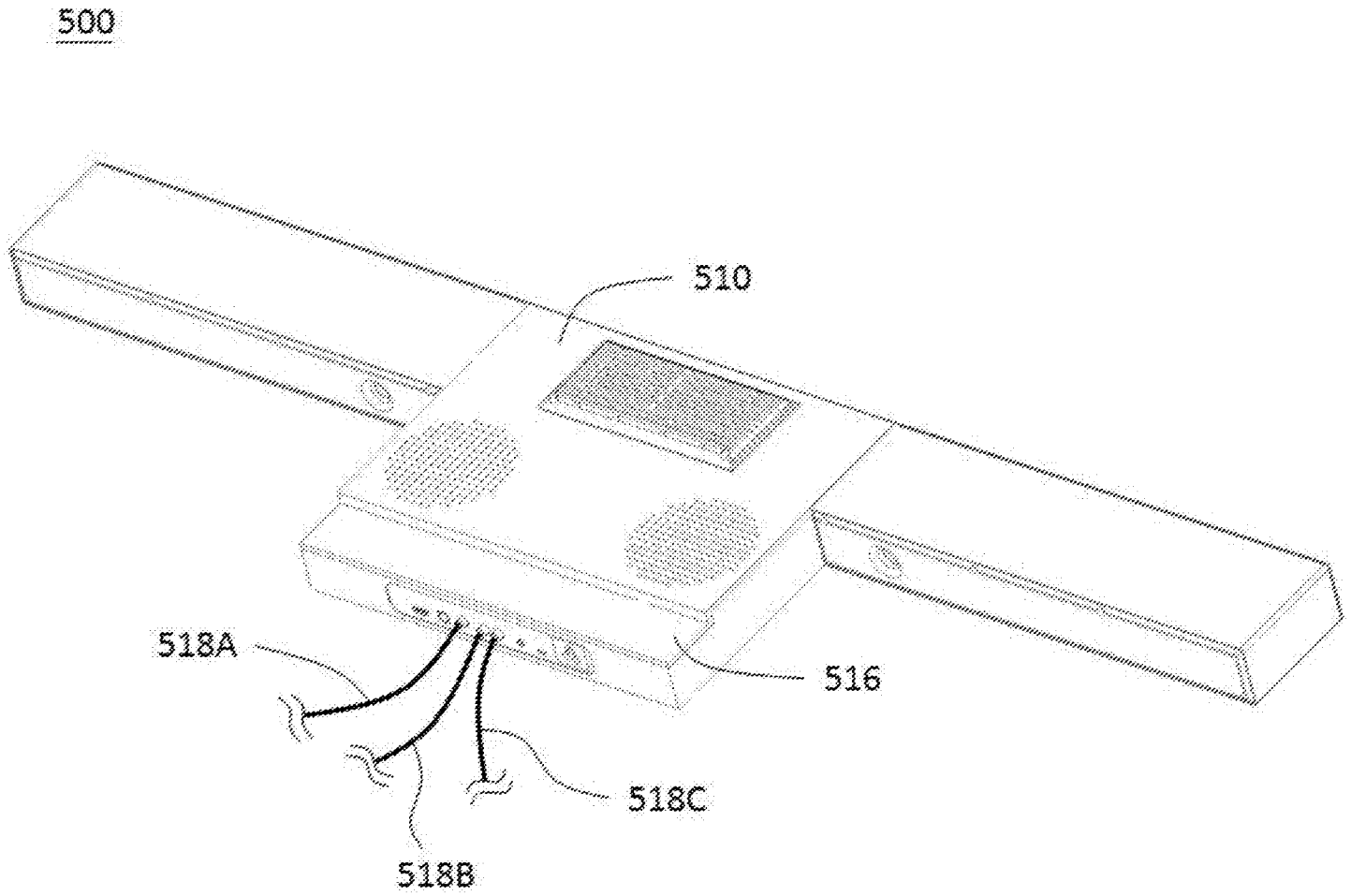
FIG. 5 is a schematic view of the three-piece extensible movable soundbox according to yet another specific embodiment of the present disclosure.

Referring to FIG. 5, there is shown a schematic view of the three-piece extensible movable soundbox according to yet another specific embodiment of the present disclosure. In the embodiment shown in FIG. 5, the rear end of the host portion 510 of the three-piece extensible movable soundbox 500 has a stepped structure 516. The rear end of the host portion 510 is connected to host portion circuits 518A, 518B, 518C. When the three-piece extensible movable soundbox 500 is placed below a television set, the stepped structure 516 of the host portion 510 enables the host portion signal lines 518A, 518B, 518C to be hidden behind the television set (as shown in FIG. 6).

Figure 6:
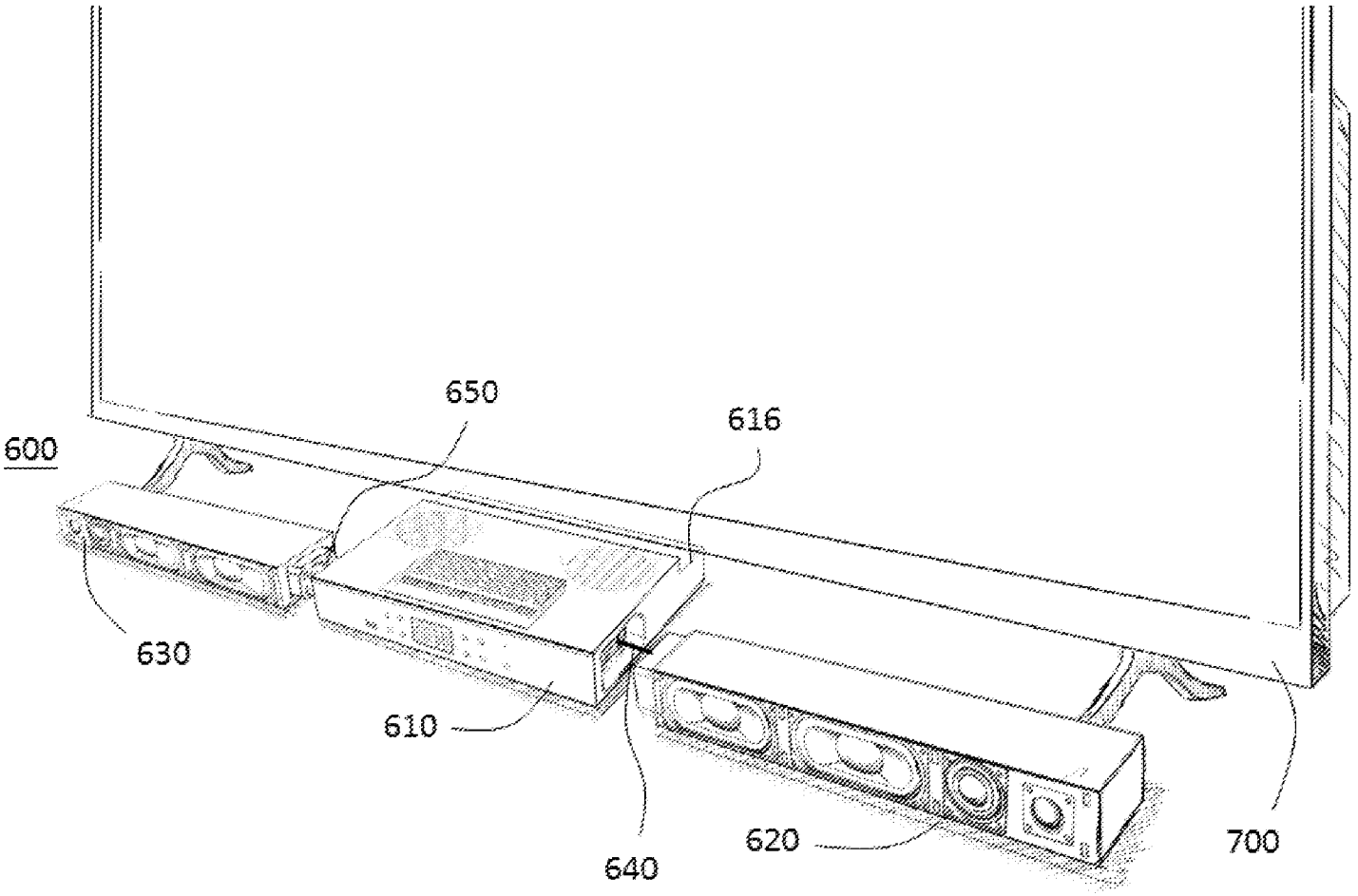
FIG. 6 is a schematic view of the three-piece extensible movable soundbox according to a further specific embodiment of the present disclosure.

Referring to FIG. 6, there is shown a schematic view of the three-piece extensible movable soundbox according to a further specific embodiment of the present disclosure. In the embodiment shown in FIG. 6, the three-piece extensible movable soundbox 600 uses a first connection line device 640 to adjust the distance between the first soundbox portion 620 and the host portion 610 and uses a second connection line device 650 to adjust the distance between the second soundbox portion 630 and the host portion 610. Hence, regardless of the size of a television set 700, the three-piece extensible movable soundbox 600 is suitable for use with the television set 700 by adjusting the positions of the host portion 610, first soundbox portion 620 and second soundbox portion 630. In addition, as shown in FIG. 6, a stepped structure 616 of the host portion 610 is disposed behind the television set 700, and thus all the host portion signal lines connected to the host portion 610 can be hidden behind the television set 700, so as to render the host portion signal lines invisible.

In a specific embodiment, the first soundbox portion and the second soundbox portion of the three-piece extensible movable soundbox are symmetrical and thus share the same die during a manufacturing process, thereby incurring low die-opening cost. Moreover, in case of a change of a model number, it is feasible to change only the die for the host portion, but the dies for the first soundbox portion and the second soundbox portion may remain unchanged, thereby cutting cost. In addition, upon its disassembly, the three-piece extensible movable soundbox has less volume than a conventional integrally-formed soundbar and thus is more suitable for production on a production line to therefore have higher production efficiency.

The three-piece extensible movable soundbox of the present disclosure is depicted with the accompanying drawings and described above. Understandably, specific embodiments of the present disclosure merely serve illustrative purposes. Various changes can be made to the specific embodiments without departing from the spirit and claims of the present disclosure and still fall within the scope of the claims of the present disclosure. Therefore, the specific embodiments of the present disclosure are not restrictive of the present disclosure, and the genuine claims and spirit of the present disclosure are disclosed below.

What is claimed is:

1. A three-piece extensible movable soundbox, comprising:

a host portion;

a first soundbox portion, wherein the host portion is extensibly connected to the first soundbox portion by a first connection line device; and a second soundbox portion, wherein the host portion is extensibly connected to the second soundbox portion by a second connection line device;

wherein a first connecting portion of the first soundbox portion is connected to a first host connecting portion of the host portion, a second connecting portion of the second soundbox portion is connected to a second host connecting portion of the host portion, the first connecting portion of the first sound box portion has a first magnet, the second connecting portion of the first sound box portion has a second magnet, the host portion has a third magnet and a fourth magnet, the first connecting portion of the first sound box portion is connected to the first host connecting portion of the host portion by the first magnet and the third magnet, and the second connecting portion of the first sound box portion is connected to the second host connecting portion of the host portion by the second magnet and the fourth magnet.

2. The three-piece extensible movable soundbox of claim 1, wherein the first connection line device comprises a first reeling device and a first connection line, the second connection line device comprises a second reeling device and a second connection line, the first reeling device extends or halts the first connection line, and the second reeling device extends or halts the second connection line.

3. The three-piece extensible movable soundbox of claim 2, wherein the first reeling device and the second reeling device are disposed in the host portion.

4. The three-piece extensible movable soundbox of claim 2, further comprising a first subsidiary component and a second subsidiary component, the first subsidiary component is demountably connected between the host portion and the first soundbox portion and contains the first connection line therein, the second subsidiary component is demountably connected between the host portion and the second soundbox portion and contains the second connection line therein.

5. The three-piece extensible movable soundbox of claim 2, wherein the first connection line is connected, in a pluggable and unpluggable manner, to the first soundbox portion, and the second connection line is connected, in a pluggable and unpluggable manner, to the second soundbox portion.

6. The three-piece extensible movable soundbox of claim 1, wherein the first connection line device comprises a first flat connection line capable of extension and connection, the first flat connection line comprises four first electrical connection lines, the second connection line device comprises a second flat connection line capable of extension and connection, and the second flat connection line comprises four second electrical connection lines.

7. The three-piece extensible movable soundbox of claim 1, wherein the first magnet, the second magnet, the third magnet and the fourth magnet are neodymium-iron-boron magnets.

8. The three-piece extensible movable soundbox of claim 1, wherein a rear end of the host portion has a stepped structure.

* * * * *